US009204722B2

(12) United States Patent
Violand et al.

(10) Patent No.: US 9,204,722 B2
(45) Date of Patent: Dec. 8, 2015

(54) DRAWER PULL-OUT GUIDE

(71) Applicant: Julius Blum GmbH, Hoechst (AT)

(72) Inventors: Wilfried Violand, Gaissau (AT); Ulrich Greussing, Bizau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/699,270

(22) Filed: Apr. 29, 2015

(65) Prior Publication Data

US 2015/0230604 A1 Aug. 20, 2015

Related U.S. Application Data

(63) Continuation of application No. PCT/AT2013/000169, filed on Oct. 14, 2013.

(30) Foreign Application Priority Data

Nov. 12, 2012 (AT) ..... 1200/2012

(51) Int. Cl.
*A47B 88/10* (2006.01)
*A47B 88/04* (2006.01)
*A47B 88/16* (2006.01)

(52) U.S. Cl.
CPC ..... *A47B 88/10* (2013.01); *A47B 88/04* (2013.01); *A47B 88/0466* (2013.01); *A47B 88/16* (2013.01)

(58) Field of Classification Search
CPC ..... A47B 2210/007; A47B 2210/0013
USPC ..... 312/330.1, 334.6–334.9, 312/334.12–334.16, 334.18, 312/334.24–334.27, 334.32, 334.33, 312/334.36, 334.37, 334.39
See application file for complete search history.

(56) References Cited

U.S. PATENT DOCUMENTS 4,659,237 A * 4/1987 Rapp ..... 384/19
5,484,199 A 1/1996 Gasser et al.

(Continued)

FOREIGN PATENT DOCUMENTS

AT 004 518 8/2001
DE 296 16 756 11/1996

(Continued)

OTHER PUBLICATIONS

International Search Report (ISR) issued Dec. 18, 2013 in International (PCT) Application No. PCT/AT2013/000169.

(Continued)

*Primary Examiner* — Matthew Ing
(74) *Attorney, Agent, or Firm* — Wenderoth, Lind & Ponack, L.L.P.

(57) ABSTRACT

A drawer pull-out guide includes a body rail which can be mounted on a furniture body via a fastening section, and a drawer rail which can be fastened on a drawer and is mounted movably relative to the body rail. The drawer rail has a side web facing the fastening section. A central rail is mounted movably between the body rail and the drawer rail, and a bearing with at least one supporting roller via which the drawer rail is supported in the closed state is on the body rail. The bearing is arranged at a front end region of the central rail or of the drawer rail so as to be non-displaceable during operation in the longitudinal direction of the rail on which the bearing is arranged. The side web of the drawer rail is arranged between the supporting roller and the fastening section of the body rail.

16 Claims, 6 Drawing Sheets

(56) References Cited

U.S. PATENT DOCUMENTS

| | | | | |
|---|---|---|---|---|
| 5,769,518 | A | 6/1998 | Grabher | |
| 5,882,100 | A | 3/1999 | Rock | |
| 7,156,478 | B2 * | 1/2007 | Harn et al. | 312/334.6 |
| 2004/0212284 | A1 | 10/2004 | Fitz | |
| 2008/0303395 | A1 * | 12/2008 | Chen et al. | 312/334.8 |

FOREIGN PATENT DOCUMENTS

| | | |
|---|---|---|
| DE | 20 2008 017 061 | 4/2009 |
| EP | 0 656 182 | 6/1995 |
| EP | 0 664 983 | 8/1995 |
| EP | 0 694 270 | 1/1996 |
| EP | 0 834 270 | 4/1998 |
| EP | 1 190 646 | 3/2002 |
| EP | 1 470 770 | 10/2004 |
| EP | 2 201 864 | 6/2010 |
| WO | WO2011146951 | * 12/2011 |

OTHER PUBLICATIONS

Austrian Patent Office Search Report (ASR) issued Jun. 11, 2013 in Austrian Patent Application No. A 1200/2012.

* cited by examiner

DRAWER PULL-OUT GUIDE

BACKGROUND OF THE INVENTION

The present invention concerns a drawer extension guide including: a carcass rail which is to be mounted to a furniture carcass by way of a fixing portion, a drawer rail which is to be fixed to a drawer and which is mounted moveably relative to the carcass rail, the drawer rail having a side limb which faces towards the fixing portion, a central rail mounted moveably between the carcass rail and the drawer rail, and a bearing having at least one supporting roller, by way of which the drawer rail is supported in the closed condition on the carcass rail. The bearing is arranged at a front end region of the central rail or the drawer rail and is arranged non-displaceably in operation in the longitudinal direction of that rail on which the bearing is arranged.

The invention further concerns an arrangement comprising a drawer and a drawer extension guide of the kind to be described.

AT 4518 U1 and EP 1 470 770 A1 each describe drawer extension guides, wherein a bearing with at least one supporting roller is arranged in the front region of the carcass rail. That supporting roller is provided to support the extension rail or the drawer connected thereto, in the closed condition. In that case, the supporting roller bears against a lateral edge region or against a bent-over portion of the extension rail. The supporting roller provides that the rollers of carriages which are mounted displaceably between the rails for transmitting the load of the drawer are relieved of the weight of the drawer and consequently protected from deformation. In addition, the supporting roller provides that the drawer is slightly lifted in the closed condition so that unwanted downward movement of the drawer is prevented. Accordingly, the horizontally extending gaps between the front panels of drawers arranged in mutually superposed relationship of a cabinet can be of a constant width so that the pattern of gaps which is visible from the exterior is also optically attractive.

"Similar drawer extension guides having the features mentioned above are disclosed in EP 0 834 270 A2, EP 1 190 646 A1, EP 0 664 983 A2 and DE 20 2008 017 061 U1. The object of the present invention is to provide a drawer extension guide of the general kind referred to in the opening part of this specification, while involving a more compact structure.

SUMMARY OF THE INVENTION

According to the invention, that object is attained by the features described below. Further advantageous configurations of the invention will also be described.

According to the invention, the side limb of the drawer rail is arranged between the supporting roller and the fixing portion of the carcass rail.

In other words, in comparison with the above-mentioned state of the art, the supporting roller is arranged centrally in the rail system of the drawer extension guide, wherein the space between a side limb of the drawer rail and the furniture carcass can be reduced and the drawer extension guide in its entirety can be made narrower.

A central arrangement of the supporting roller in the guide system also provides a central distribution of load, wherein the at least one supporting roller can be disposed in a compact configuration between adjacent and relatively moveable rails of the drawer extension guide in a comparatively narrow intermediate region. Unlike the situation in the above-mentioned state of the art in which the supporting roller is mounted laterally, the structure according to the invention also provides that no lateral tilting moment is exerted on the carriages disposed between the rails so that the carriages are substantially vertically loaded and no twisting of the drawer extension guide is caused.

In addition, it is no longer necessary for the drawer rail to be provided with a bent-over portion, by which the drawer rail can be supported on the supporting roller. This is possible because, with the configuration according to the invention, the supporting roller can cooperate directly with the running limbs of the rails.

A further embodiment provides that the central rail has a lateral profile portion facing towards the side limb of the drawer rail, wherein the lateral profile portion of the central rail is arranged between the supporting roller and the side limb of the drawer rail.

The drawer rail can have a cavity which is delimited by the rail profile of the drawer rail, the supporting roller being arranged within the cavity. In that respect, it may be advantageous if the drawer rail has two side limbs and a central limb which connects the side limbs. The central limb is preferably flat, and the supporting roller is arranged preferably completely within the two side limbs of the drawer rail. In that case, the supporting roller can cooperate on the one hand with the underside of the central limb of the drawer rail and on the other hand with a running limb of the carcass rail.

The bearing with the supporting roller can be arranged, for example, on the drawer rail, wherein the supporting roller, in the closed condition of the drawer rail, cooperates with the carcass rail.

In a full-extension drawer arrangement, the drawer extension guide usually has a central rail mounted displaceably between the carcass rail and the extension rail. In this case, the bearing with the supporting roller can be mounted on the central rail, wherein the supporting roller cooperates on the one hand with the carcass rail and on the other hand with the drawer rail.

The supporting roller is arranged at a front end region of the central rail or at a front end region of the drawer rail, wherein the supporting roller is arranged rotatably but non-displaceably in the longitudinal direction of that rail on which the bearing is arranged, in operation (that is to say upon a relative movement of the rails 5, 7, 8 relative to each other). The term "front end region of the rail" means in each case the foremost third of the length of the central rail or the foremost third of the drawer rail in the mounted condition.

Arranging the bearing with the supporting roller on the central rail or on the drawer rail makes it possible to substantially prevent jamming of carriages or rolling bodies—which are usually mounted displaceably between the rails of the drawer extension guide. Thus, the travel movement of the drawer extension guide is improved.

BRIEF DESCRIPTION OF THE DRAWINGS

Further details and advantages of the present invention will be described by means of the embodiments by way of example shown in the Figures in which.

DETAILED DESCRIPTION OF THE INVENTION

Figure 1:
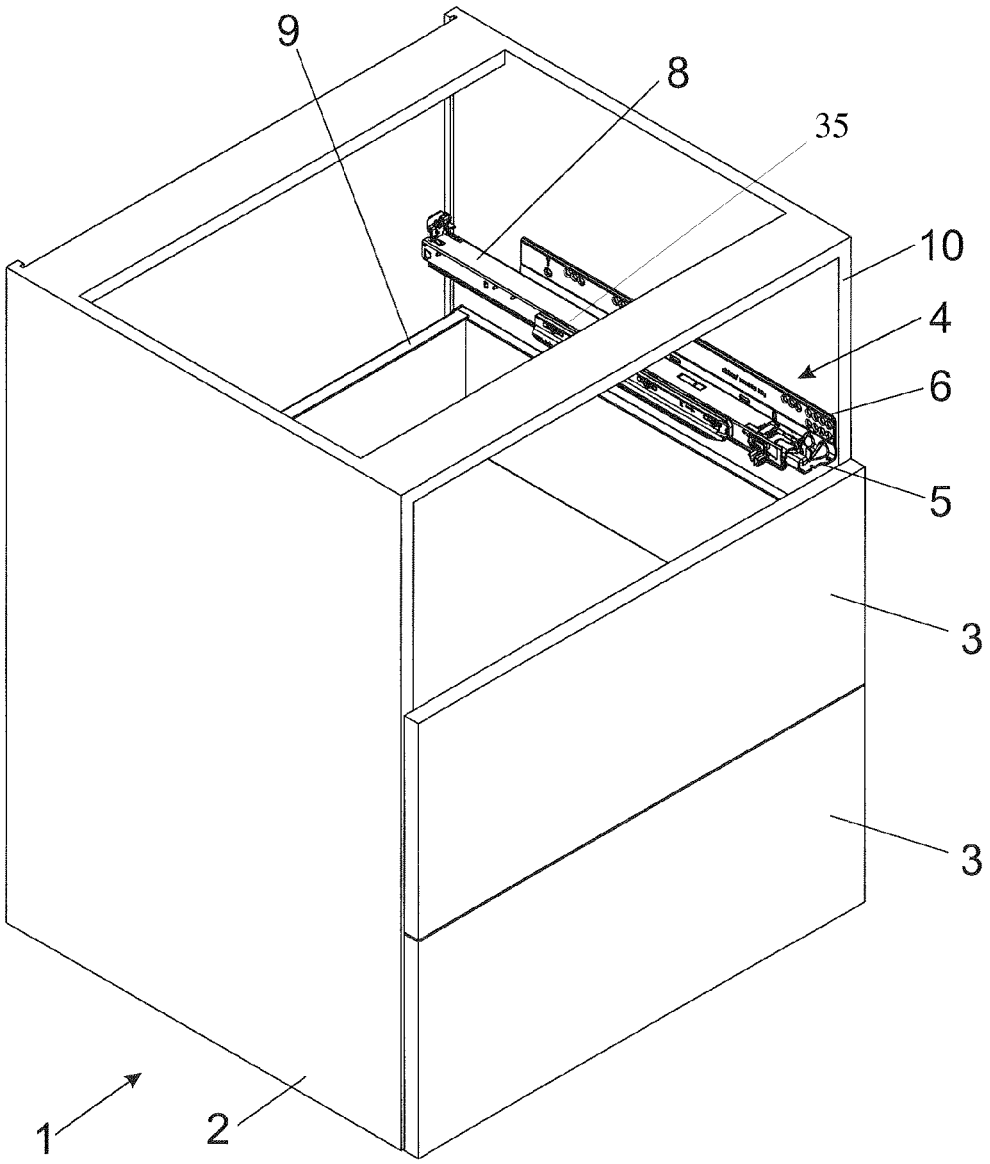
FIG. 1 is a perspective view of an article of furniture having a furniture carcass and drawers displaceable relative thereto.

FIG. 1 shows an article of furniture 1 having a furniture carcass 2 and drawers 3 displaceable relative thereto, as a perspective view. Provided for displaceably mounting the drawers 3 are drawer extension guides 4 which each have a carcass rail 5 to be fixed to the furniture carcass 2, and a drawer rail 8 which is displaceable relative to the carcass rail 5. A central rail 7 (not visible here) is mounted displaceably between the carcass rail 5 and the drawer rail 8, with at least one running carriage 35 arranged between the carcass rail 5 and the central rail 7 and/or between the central rail 7 and the drawer rail 8. The central rail 7 makes it possible to provide for full extension of the drawer 3 so that the rear wall 9 of the drawer 3 can be pulled out substantially as far as the front end 10 of the furniture carcass 2 (i.e., the rear wall 9 is substantially flush with the front end 10).

Figure 2A:
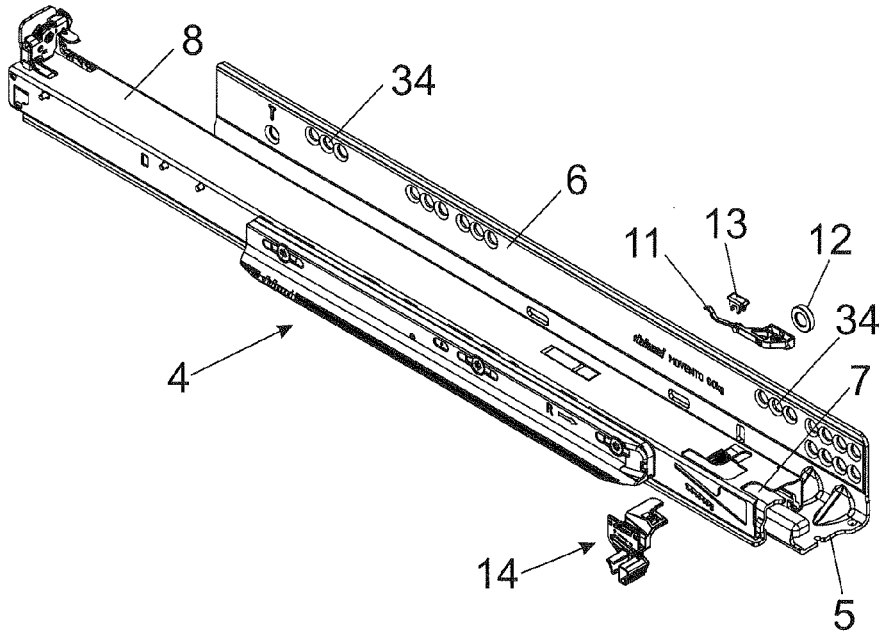
FIGS. 2*a* and 2*b* are a perspective view of a drawer extension guide and an enlarged view of the front end region of the drawer extension guide, respectively.

FIG. 2*a* shows a perspective view of the drawer extension guide 4. The carcass rail 5 is to be fixed to a furniture carcass 2 by a fixing portion 6 extending perpendicularly in the mounted condition, and the displaceable drawer rail 8 is to be connected to the drawer 3. The fixing portion 6 has a plurality of openings 34 for receiving fixing screws. The central rail 7 is mounted displaceably between the carcass rail 5 and the drawer rail 8. It is possible to see a bearing 11 having a supporting roller 12 by way of which the drawer rail 8 is supported in the closed position on the carcass rail 5. A snap-action connector 13 is provided for fixing the bearing 11 to the rails 7, 8.

Figure 2B:
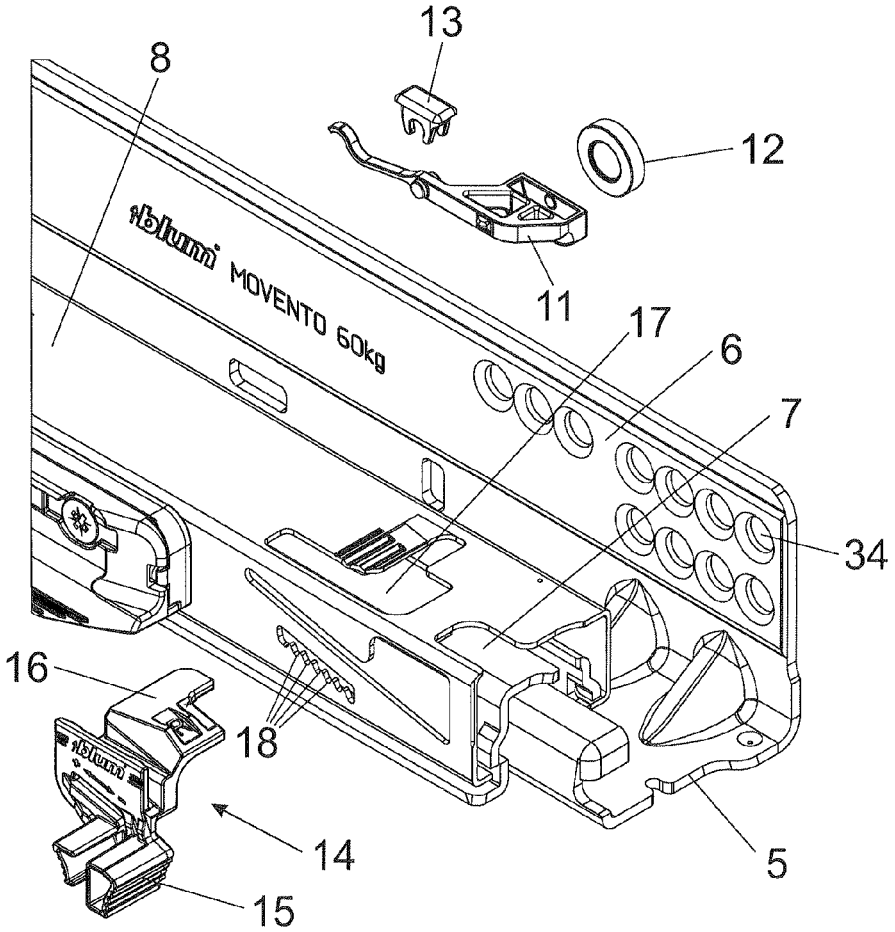

FIG. 2*b* shows a view on an enlarged scale of the front end region of the drawer extension guide 4. The front end region of the drawer 3 can be raised and lowered by way of a height adjusting device 14. The height adjusting device 14 includes a gripping portion 15 which is to be manually actuated, and has a mounting portion 16 which is connected thereto and on which a lateral edge region of the drawer 3 rests in the mounted condition. The gripping portion 15 can be positioned at any one of a plurality of predetermined latching positions 18 of the drawer rail 8, wherein the mounting portion 16 (and therewith the front end region of a drawer 3) assumes a different height position depending on the selection of a respective latching position 18.

Figure 3A:
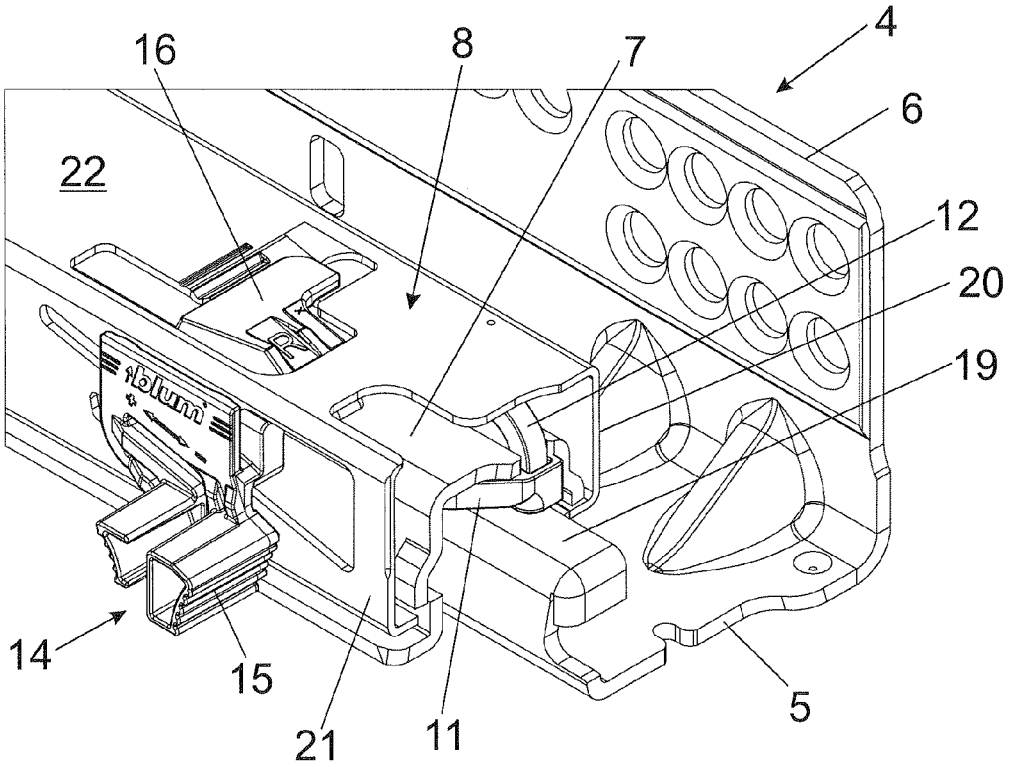
FIGS. 3*a* and 3*b* are a perspective view and a vertical section of the front end region of the drawer extension guide, respectively.

FIG. 3*a* shows a perspective view of the front end region of the drawer extension guide 4. The carcass rail 5 has the fixing portion 6 for mounting to the furniture carcass 2, and a horizontal limb 19 on which the supporting roller 12 is supported in the closed position of the drawer rail 8. In the illustrated embodiment, the bearing 11 with the supporting roller 12 is fixed to the central rail 7. The supporting roller 12 cooperates on the one hand with the underside of a central limb 22 of the drawer rail 8, and on the other hand with the horizontal limb 19 of the carcass rail 5. The drawer rail 8 has a first side limb 20 facing towards the fixing portion 6, and the first side limb 20 of the drawer rail 8 is arranged between the supporting roller 12 and the fixing portion 6 of the carcass rail 5. The drawer rail 8 has two side limbs 20, 21 and the, preferably flat, central limb 22 connecting the side limbs 20, 21, wherein the supporting roller 12 is arranged, preferably completely, between the two side limbs 20, 21 of the drawer rail 8. The mounting portion 16, on which the front end region of the drawer 3 rests, is adapted to be adjustable in respect of height by way of the gripping portion 15 of the height adjusting device 14.

Figure 3B:
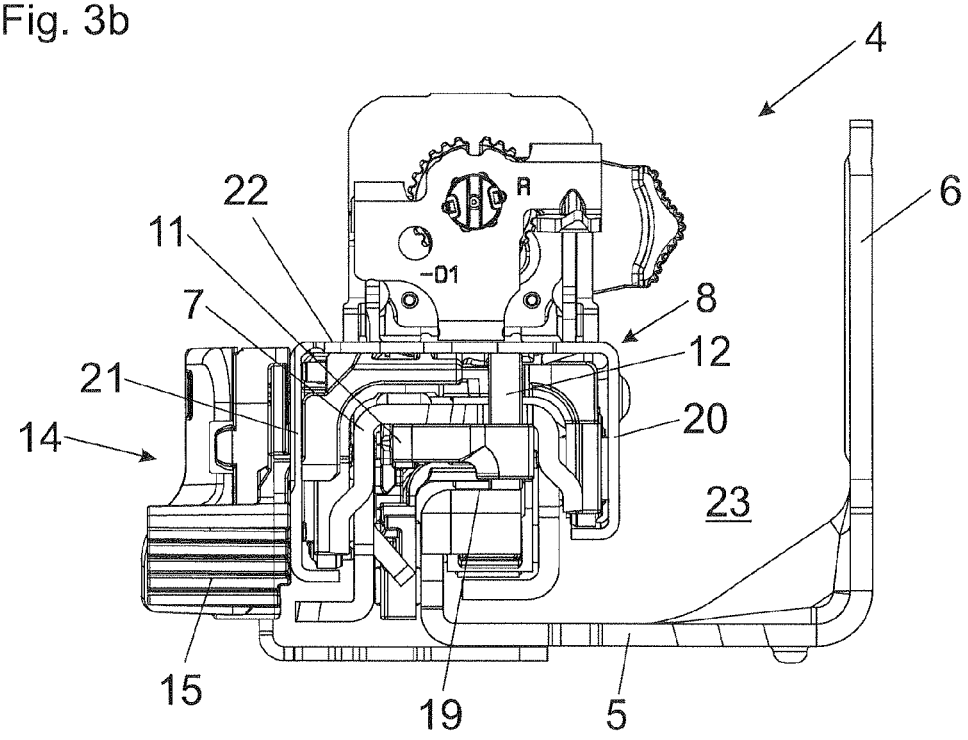

FIG. 3*b* shows a vertical section of the drawer extension guide 4 shown in FIG. 3*a*. The drawer rail 8 has a cavity delimited by the rail profile of the drawer rail 8, wherein the supporting roller 12 is arranged preferably completely within that cavity. The drawer rail 8 is at least partially open downwardly. The central arrangement of the supporting roller 12 between relatively moveable rails 5, 7, 8 of the drawer extension guide 4 provides that the supporting roller 12 can be disposed in a compact arrangement in a comparatively narrow intermediate region, wherein the space 23 between the side limb 20 of the drawer rail 8 and the fixing portion 6 of the carcass rail 5 can be reduced in size and the drawer extension guide 4 overall can be made narrower and consequently more compact.

Figure 4A:
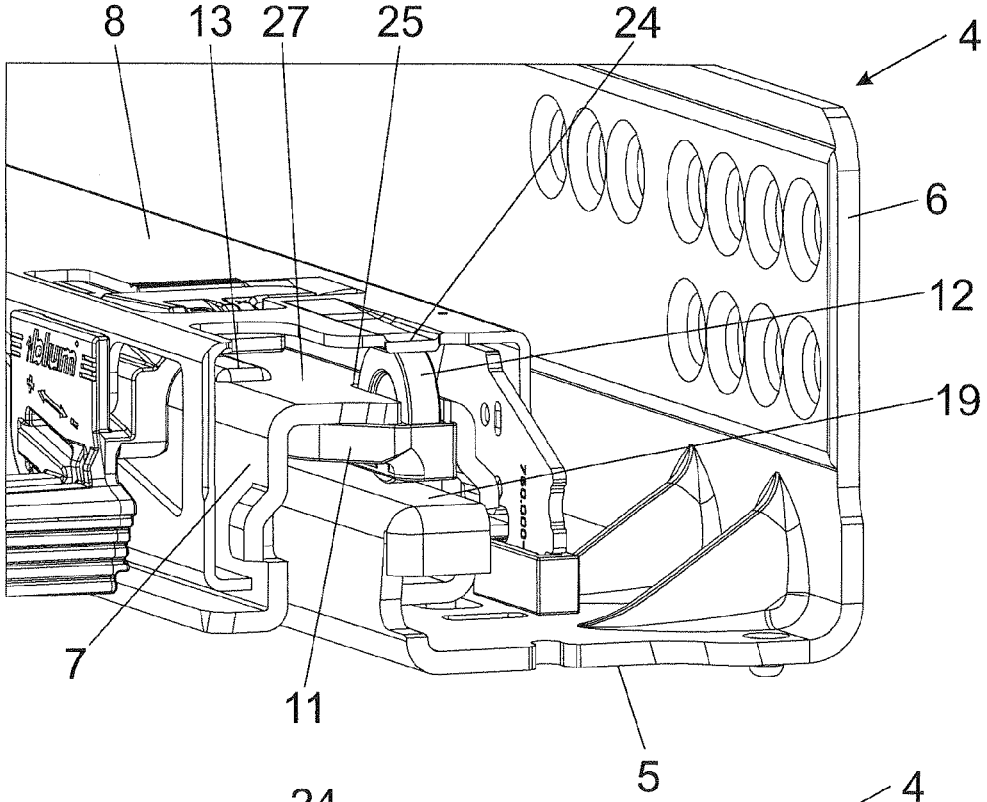
FIGS. 4*a* and 4*b* are a perspective view and a vertical section of the front end region of the drawer extension guide according to a slightly modified embodiment.

FIG. 4*a* shows a slightly modified embodiment of the front end region of the drawer extension guide 4. The bearing 11 with the supporting roller 12 is pivotably fixed to the central rail 7 by the snap-action connector 13. In the illustrated embodiment, the central rail 7 has a horizontal limb 27, at the front end of which is arranged a recess 25 which extends in the longitudinal direction of the horizontal limb 27 and is open forwardly. The recess 25 is adapted to receive the supporting roller 12. In the front end region, the drawer rail 8 has a heightened portion 24, preferably in the form of a stamped (pressed) portion, which cooperates with the supporting roller 12 in the closed condition of the drawer rail 8. The heightened portion 24 provides that the drawer rail 8 can be raised to a defined degree in the closed condition, while unwanted downward movement of a heavily loaded drawer 3 can be substantially prevented. A further function of the heightened portion 24 is that the drawer rail 8 is admittedly supported on the supporting roller 12 by that heightened portion 24 in the closed condition, but upon opening of the drawer rail 8 (which in the case of a differential extension arrangement moves at approximately twice the speed of the central rail 7), the supporting roller 12 is freed from the drawer rail 8 immediately. Thus, the load of the drawer 3 is transmitted exclusively by carriages (not shown) with rolling bodies which are usually mounted displaceably between the rails 5, 7, 8 of the drawer extension guide 4. In that way, the forces involved in the travel movement of the drawer extension guide 4 can be reduced.

Figure 4B:
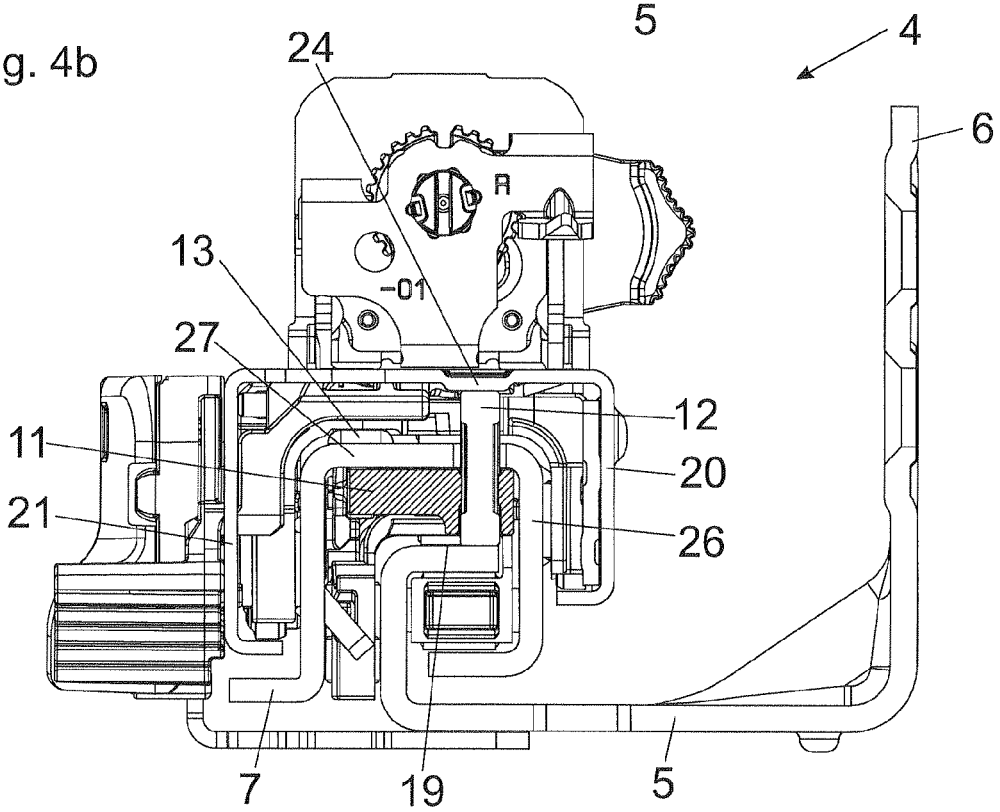

FIG. 4*b* shows a vertical section of the embodiment of the drawer extension guide 4 shown in FIG. 4*a*. It will be seen that, with the drawer rail 8 closed, the supporting roller 12 cooperates on the one hand with the heightened portion 24 of the drawer rail 8 and on the other hand with the horizontal limb 19 of the carcass rail 5. The central rail 7 has a lateral profile portion 26 facing towards the first side limb 20 of the drawer rail 8, wherein the lateral profile portion 26 of the central rail 7 is disposed between the supporting roller 12 and the first side limb 20 of the drawer rail 8. In this embodiment, both the lateral profile portion 26 of the central rail 7 and also the first side limb 20 of the drawer rail 8 are disposed between the supporting roller 12 and the fixing portion 6 of the carcass rail 5. The supporting roller 12 projects upwardly and downwardly beyond the horizontal limb 27 of the central rail 7.

Figure 5A:
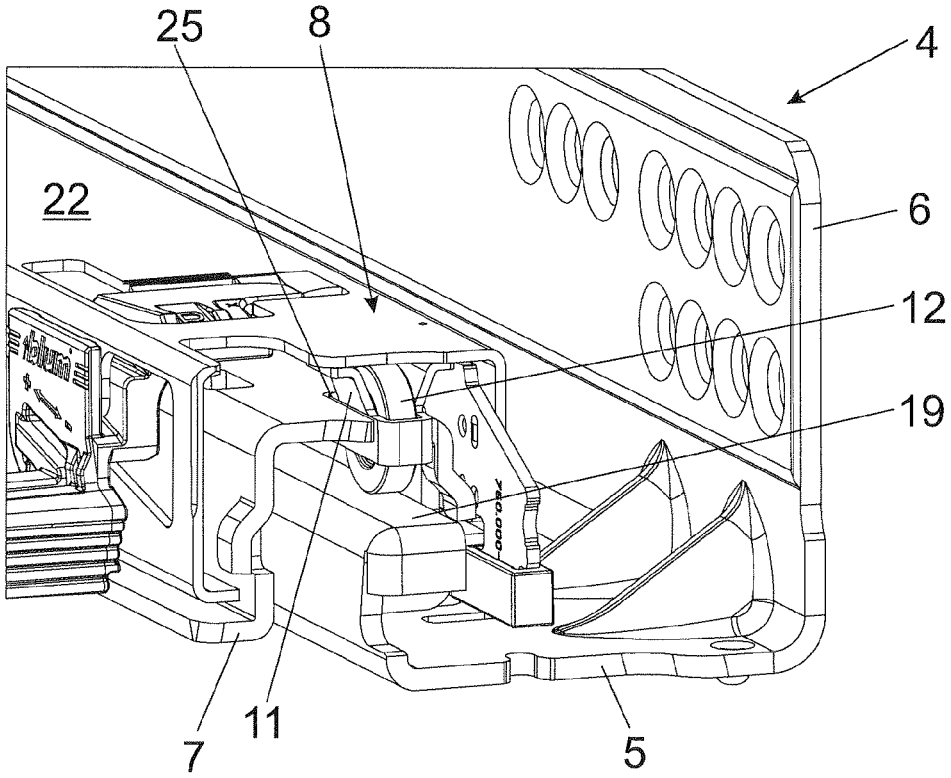
FIGS. 5*a* and 5*b* are a perspective sectional view and a vertical section, respectively, of the front end region of the drawer extension guide, wherein the bearing with the supporting roller is fixed to the drawer rail.

FIG. 5*a* shows the front end region of the drawer extension guide 4, in which the bearing 11 with the supporting roller 12—unlike the preceding embodiment—is arranged on the drawer rail 8. The bearing 11 is connected, preferably welded or riveted, to the underside of the central limb 22 of the drawer rail 8. The bearing 11 with the supporting roller 12 is arranged at the front end region of the drawer rail 8, and the supporting roller 12, towards the end of the closing movement of the drawer rail, can pass into a forwardly open recess 25 in the central rail 7, the supporting roller 12 being accommodated in the recess 25 in the central rail 7 when the drawer rail 8 is closed.

Figure 5B:
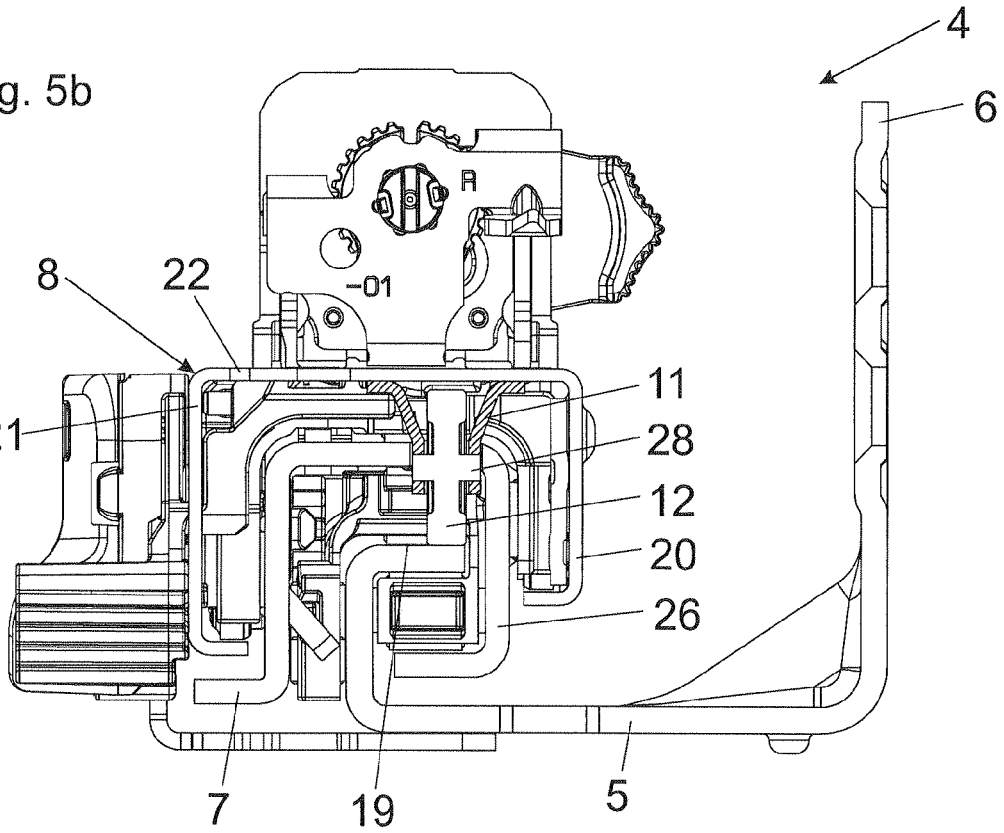

FIG. 5*b* shows a vertical section of the FIG. 5*a* embodiment. In this case, the bearing 11 has a stationary, horizontally extending trunnion 28, the supporting roller 12 being mounted rotatably at the trunnion 28. In the closed position of the drawer extension guide 4, the supporting roller 12 cooperates on the one hand with the underside of the central limb 22 of the drawer rail 8 and on the other hand with the horizontal limb 19 of the carcass rail 5. The lateral profile portion 26 of the central rail 7 facing towards the side limb 20 of the drawer rail 8 is arranged between the supporting roller 12 and the side limb 20 of the drawer rail 8.

Figure 6A:
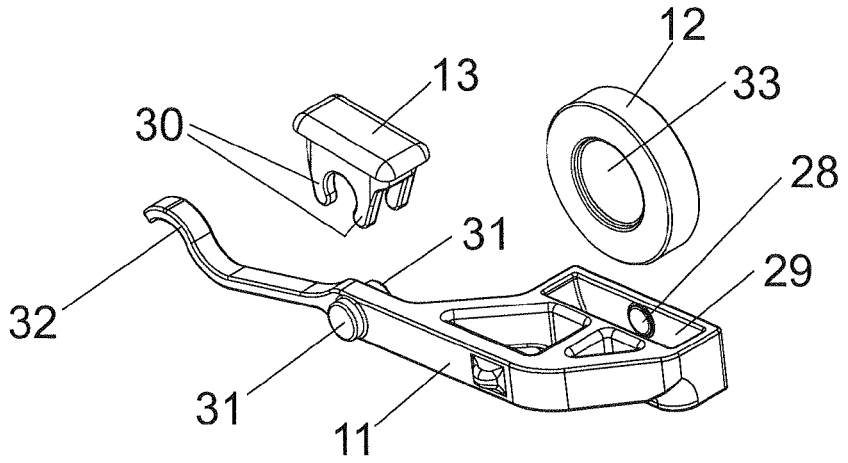
FIGS. 6*a*-6*c* are various views of a possible embodiment of a bearing.

FIG. 6*a* shows a perspective view of a possible embodiment of the bearing 11. The bearing 11 is to be fixed, preferably pivotably, to the central rail 7 or to the drawer rail 8 of the drawer extension guide 4, by way of a snap-action connector 13. The snap-action connector 13 has two resilient arresting elements 30 which, in the mounted position, embrace the projections 31 on the bearing 11 in positively locking relationship. The bearing 11 also has a resilient arm 32, wherein the free end of the arm 32 in the mounted position is supported at that rail 7 and 8 on which the bearing 11 is arranged. Tolerances in the drawer extension guide, which occur in the heightwise direction, can be substantially compensated for by the resilient arm 32. The bearing 11 includes a guide 29 which surrounds the supporting roller 12 on all sides and in which the supporting roller 12 is loosely accommodated. The supporting roller 12 is mounted limitedly moveably in respect of height by the guide 29. That mounting for the supporting roller 12 in a vertical direction can be achieved by at least one trunnion 28 of the bearing 11 projecting into an, preferably non-through going, opening 33 in the supporting roller 12, the diameter of the opening 33 being larger than the diameter of the trunnion 28. The supporting roller 12 thus does not have a stationary axis of rotation, but an axis of rotation which is moveable in respect of height. In that way, it is possible to accommodate additional tolerances in the guide system.

Figure 6B:
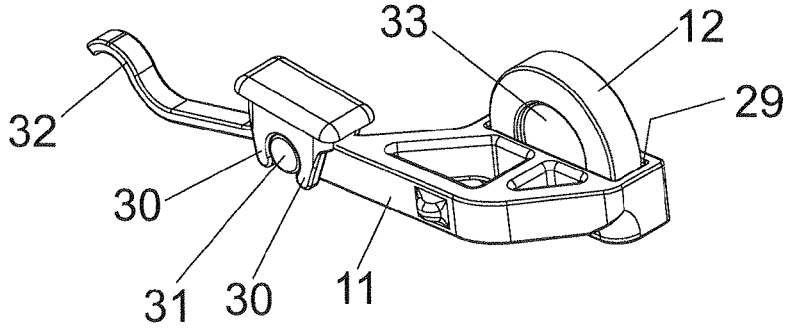

FIG. 6*b* shows the bearing 11 with the supporting roller 12 fitted in the guide 29 and the fitted snap-action connector 13, wherein the arresting elements 30 of the snap-action connector 13 embrace the projections 31 in positively locking relationship.

Figure 6C:
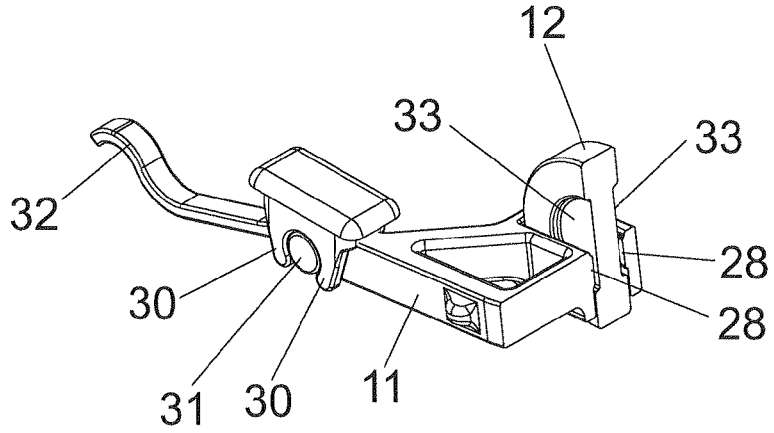

FIG. 6*c* shows a perspective view in section of the bearing 11. The supporting roller 12 is held moveably in respect of height by trunnions 28 which are arranged at both sides on the guide 29 and which respectively extend into an opening 33, in the form of a blind hole, in the supporting roller 12. The bearing 11 is made in one piece and can be easily produced from a plastic material by an injection molding process. The supporting roller 12 can also comprise plastic or metal. When the supporting roller 12 is made of metal, a plastic coating therearound may be desirable. In all embodiments, the supporting roller 12 can be of a spherical, cylindrical, disk-shaped or frustoconical configuration. It will be appreciated that it is also possible to provide two or more supporting rollers 12 which are arranged laterally one beside the other, preferably on a common axis, or also in such a way that the supporting rollers 12 are arranged one behind the other in the direction of displacement of the drawer rail 8.

The invention claimed is:

1. A drawer extension guide including:

a carcass rail having a fixing portion to be mounted to a furniture carcass, a drawer rail to be fixed to a drawer and mounted moveably relative to the carcass rail, the drawer rail having a side limb facing towards the fixing portion of the carcass rail, a central rail mounted moveably between the carcass rail and the drawer rail so as to allow full extension of the drawer such that a rear wall of the drawer is at least substantially flush with a front end of the furniture carcass in an open position, the central rail having a lateral profile portion facing towards the side limb of the drawer rail a running carriage arranged between the carcass rail and the central rail, and a bearing having at least one supporting roller configured such that the drawer rail is supported in a closed position of the drawer on the carcass rail by the at least one supporting roller, wherein the bearing is arranged at a front end region of the central rail or the drawer rail, and is arranged so as to be non-displaceable in the longitudinal direction relative to the central rail or the drawer rail on which the bearing is arranged, wherein the side limb of the drawer rail is arranged between the supporting roller of the bearing and the fixing portion of the carcass rail, wherein the lateral profile portion of the central rail is located between the supporting roller of the bearing and the side limb of the drawer rail, and wherein a rail profile of the drawer rail delimits a cavity within the drawer rail, the supporting roller being arranged within the cavity.

2. The drawer extension guide according to claim 1, wherein the side limb of the drawer rail is a first side limb of two side limbs, and the drawer rail further having a central limb which connects the two side limbs, the supporting roller being located between the two side limbs of the drawer rail.

3. The drawer extension guide according to claim 2, wherein the supporting roller is configured to engage a lower surface of the central limb of the drawer rail and a horizontal limb of the carcass rail.

4. The drawer extension guide according to claim 2, wherein the central limb is flat, and an entirety of the supporting roller is located between the two side limbs of the drawer rail.

5. The drawer extension guide according to claim 1, wherein the drawer rail has an at least partially open configuration facing downwardly.

6. The drawer extension guide according to claim 1, wherein the bearing for the supporting roller has at least one trunnion.

7. The drawer extension guide according to claim 6, wherein the at least one trunnion projects into an opening of the supporting roller.

8. The drawer extension guide according to claim 7, wherein the diameter of the opening is larger than the diameter of the trunnion.

9. The drawer extension guide according to claim 7, wherein the opening is a non-through opening.

10. The drawer extension guide according to claim 1, wherein the supporting roller is mounted moveably in respect of height.

11. The drawer extension guide according to claim 1, wherein the bearing has a guide in which the supporting roller is mounted so as to be limitedly moveable in the vertical direction.

12. The drawer extension guide according to claim 1, wherein the bearing is configured to be connected to one of the carcass rail, the drawer rail, or the central rail by a snap-action connector.

13. The drawer extension guide according to claim 1, wherein the bearing is made from a plastic material.

14. An arrangement comprising:

a drawer; and the drawer extension guide according to claim 1.

15. The drawer extension guide according to claim 1, further comprising a running carriage arranged between the carcass rail and the central rail, or between the central rail and the drawer rail.

16. A drawer extension guide including: a carcass rail having a fixing portion to be mounted to a furniture carcass, a drawer rail to be fixed to a drawer and mounted moveably relative to the carcass rail, the drawer rail having a side limb facing towards the fixing portion of the carcass rail, a central rail mounted moveably between the carcass rail and the drawer rail so as to allow full extension of the drawer such that a rear wall of the drawer is at least substantially flush with a front end of the furniture carcass in an open position, the central rail having a lateral profile portion facing towards the side limb of the drawer rail, a running carriage arranged between the carcass rail and the central rail, and a bearing having at least one supporting roller configured such that the drawer rail is supported in a closed position of the drawer on the carcass rail by the at least one supporting roller, wherein the bearing is arranged at a front end region of the central rail or the drawer rail, and is arranged so as to be non-displaceable in the longitudinal direction relative to the central rail or the drawer rail on which the bearing is arranged, wherein the side limb of the drawer rail is arranged between the supporting roller of the bearing and the fixing portion of the carcass rail, and wherein the lateral profile portion of the central rail is located between the supporting roller of the bearing and the side limb of the drawer rail, wherein the central rail has a horizontal limb, wherein the supporting roller projects upwardly and downwardly beyond the horizontal limb of the central rail.

* * * * *